US006229272B1

(12) United States Patent
Root

(10) Patent No.: US 6,229,272 B1
(45) Date of Patent: May 8, 2001

(54) HIGH SPEED PHOTOGRAPHY LIGHT SOURCE

(75) Inventor: Robert G. Root, Boston, MA (US)

(73) Assignee: Prism Science Works Incorporated, Boston, MA (US)

( * ) Notice: Subject to any disclaimer, the term of this patent is extended or adjusted under 35 U.S.C. 154(b) by 0 days.

(21) Appl. No.: 09/404,929

(22) Filed: Sep. 24, 1999

Related U.S. Application Data

(60) Provisional application No. 60/101,837, filed on Sep. 25, 1998.

(51) Int. Cl.[7] ..... H01J 11/04

(52) U.S. Cl. ..... 315/335; 315/112; 315/111.21; 313/491; 313/493; 313/634

(58) Field of Search ..... 315/335, 112, 315/111.21, 326, 291; 313/491, 493, 492, 110, 631, 632, 634, 635, 231.31, 603, 668, 624, 625, 231.71, 231.41, 231.61

(56) References Cited

U.S. PATENT DOCUMENTS

| | | | | |
|---|---|---|---|---|
| 4,660,076 | * | 4/1987 | Knapp et al. | 358/73 |
| 5,173,643 | * | 12/1992 | Sullivan et al. | 315/276 |
| 5,285,131 | * | 2/1994 | Muller et al. | 313/578 |
| 5,525,870 | * | 6/1996 | Matsuzawa et al. | 315/209 R |
| 5,945,790 | * | 8/1999 | Schaefer | 315/335 |
| 5,952,768 | * | 9/1999 | Strok et al. | 313/110 |
| 5,969,484 | * | 10/1999 | Santi et al. | 315/247 |
| 5,982,156 | * | 11/1999 | Weimer et al. | 323/222 |
| 6,008,567 | * | 12/1999 | Aizawa et al. | 131/25 |
| 6,069,454 | * | 5/2000 | Bouwman et al. | 315/209 R |

OTHER PUBLICATIONS

Plasma discharge replacement for argon candles, Prepared by: Robert G. Root and Paul Falkos, p. 1–11 No Date.
Repetitively pulsed plasma illumination source improvements, Prepared by: Robert G. Root and Paul Falkos, p. 1–12 No Date.
Intense Visible Pulsed Light Source For Test Instrumentation, Prepared by: Robert G. Root and Paul Falkos, p. 1–108 No Date.

* cited by examiner

*Primary Examiner*—David Vu
*Assistant Examiner*—Tuyet T. Vo
(74) *Attorney, Agent, or Firm*—Weingarten, Schurgin, Gagnebin & Hayes LLP

(57) ABSTRACT

A flash illumination system is provided which is especially useful for high-speed photography. In one embodiment, the invention provides a surface discharge lamp which produces an intense broadband burst of light having an intended spectrum. Another embodiment of the invention provides a surface discharge lamp which produces multiple pulses of intense broadband illumination at very high pulse repetition rates. The lamp in either embodiment is fabricated in a relatively inexpensive manner and can be compactly constructed and of modular construction to suit various applications. The lamp is composed of a gas envelope in which is provided a dielectric substrate and electrodes at respective ends of a surface of the substrate. The substrate is preferably a portion of the enclosure. A backplane is disposed outside the enclosure and confronting the opposite surface of the substrate between the electrodes. The lamp is energized by a pulse-forming network (PFN) powered by a high voltage supply, and a plasma is created across the dielectric surface separating the electrodes. For single pulse operation, the backplane is connected to the ground electrode. For repetitive pulse operation, the backplane is connected to a trigger source which provides a trigger pulse to initiate plasma dischage.

20 Claims, 13 Drawing Sheets

HIGH SPEED PHOTOGRAPHY LIGHT SOURCE

CROSS REFERENCE TO RELATED APPLICATIONS

This application claims the benefit under 35 U.S.C. 119(e) of U.S. Provisional Patent Application No. 60/101,837 filed Sep. 25, 1998.

This invention was made with government support. The U.S. Government has certain rights in this invention.

BACKGROUND OF THE INVENTION

For high-speed photography, electronic imaging and other purposes, it is often necessary to provide intense broadband illumination. For providing a single burst of intense illumination lasers have been employed but are expensive and do not provide broadband illumination. An argon candle is also known for providing a one-time intense light burst that destroys the lamp. Such argon candles are also potentially destructive of their surroundings and are prone to malfunction. For repetitive light bursts, strobe lamps are known and can be made extremely cheaply however inexpensive lamps are not usually useful for high repetition rate applications. In addition, existing strobe lamps cannot handle very high power and therefore cannot provide levels of illumination necessary for many purposes. Surface discharge lamps are also known but have not achieved the necessary performance for many purposes.

BRIEF SUMMARY OF THE INVENTION

A flash illumination system is provided which is especially useful for high-speed photography. In one embodiment, the invention provides a surface discharge lamp which produces an intense broadband burst of light having an intended spectrum. Another embodiment of the invention provides a surface discharge lamp which produces multiple pulses of intense broadband illumination at very high pulse repetition rates. The lamp in either embodiment is fabricated in a relatively inexpensive manner and can be compactly constructed and of modular construction to suit various applications. The lamp is composed of a gas envelope in which is provided a dielectric substrate and electrodes at respective ends of a surface of the substrate. The substrate in some embodiments is a portion of the enclosure. A backplane is disposed outside the enclosure and confronting the opposite surface of the substrate between the electrodes. The backplane provides capacitive coupling to the plasma and constrains the plasma to a thin region near the dielectric substrate surface. The backplane is also operative to reduce the breakdown voltage necessary to initiate the plasma. In addition the external backplane serves as a heat sink for dissipation of heat generated during lamp operation.

The lamp is energized by a pulse-forming network (PFN) powered by a high voltage supply, and a plasma is created across the dielectric surface separating the electrodes. For single pulse operation, where the lamp produces a single high intensity burst of light, the backplane is connected to the ground electrode as a current return, and the lamp is triggered by an electrical pulse applied to the electrodes from the PFN. For repetitive pulse operation where the lamp produces a train of light pulses at high repetition rates, the backplane is not connected to the ground electrode but rather is connected to a trigger source. To initiate plasma discharge, the lamp is triggered by an electrical pulse applied to the backplane and plasma discharge is maintained by the pulses applied to the electrodes.

The lamp is of simple rugged construction and is relatively inexpensive. The geometry of the lamp can be readily configured to suit particular illumination requirements, and two or more lamps can be interconnected to provide a desired illumination pattern.

The PFN may be separated from the one or more lamps by a low inductance high capacitance interconnecting cable which is part of the PFN and which serves as a peaking capacitor to enhance the triggering voltage of the lamp(s). The separation of the lamp(s) from the PFN is especially useful in high speed photography of explosions and other events which are likely to destroy the lamp(s).

The plasma is predominantly composed of ions of the gas in the envelope, but includes a small contribution from the substrate material which can be employed to enhance the radiative output in selected spectral bands. Radiation is usually intended in the visible spectrum for exposure of photographic film. However, radiation can also be in the infrared (IR) and ultraviolet (UV) bands. For visible wavelengths and for infrared, the gas environment is typically xenon, argon or krypton For UV the gas can typically be xenon or argon. For some purposes, the lamp can be operated with or without an envelope in an air environment, and can also be used at sub-atmospheric pressure.

DETAILED DESCRIPTION OF THE INVENTION

Figure 1:
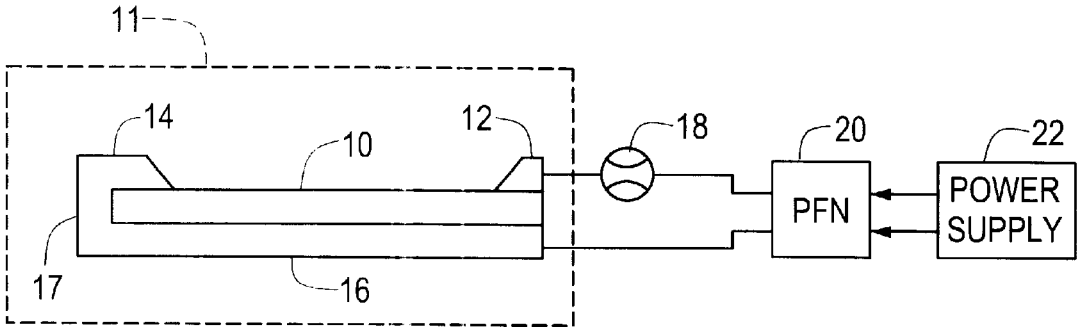
FIG. 1 PRIOR ART
FIG. 1 is a schematic diagram of a known surface discharge lamp.

A known surface discharge lamp and energy supply is shown schematically in FIG. 1. A substrate 10 of dielectric material such as alumina has one electrode 12 disposed on one end of the substrate and another electrode 14 disposed at the opposite end of the substrate. A backplane 16 is disposed on the back surface of the dielectric substrate 10 and is electrically connected to the ground electrode by section 17. An envelope 11 encloses this structure and has at least the portion of the envelope in front of the substrate surface formed of a transparent material. The electrodes are typically composed of tungsten and the backplane is typically copper. The electrodes are connected by way of a high voltage switch 18 to a pulse-forming network (PFN) 20 which is powered by a high-voltage power supply 22. The high-voltage switch is typically a spark gap which when triggered causes an energizing pulse to be applied across the electrodes, which in turn causes a plasma to be created across the dielectric substrate surface between the electrodes. The backplane provides capacitive coupling to the plasma and is effective to constrain the plasma to a thin region near the substrate surface and within the perimeter of the backplane. The backplane is also operative to reduce the breakdown voltage needed to form the plasma.

Figure 2:
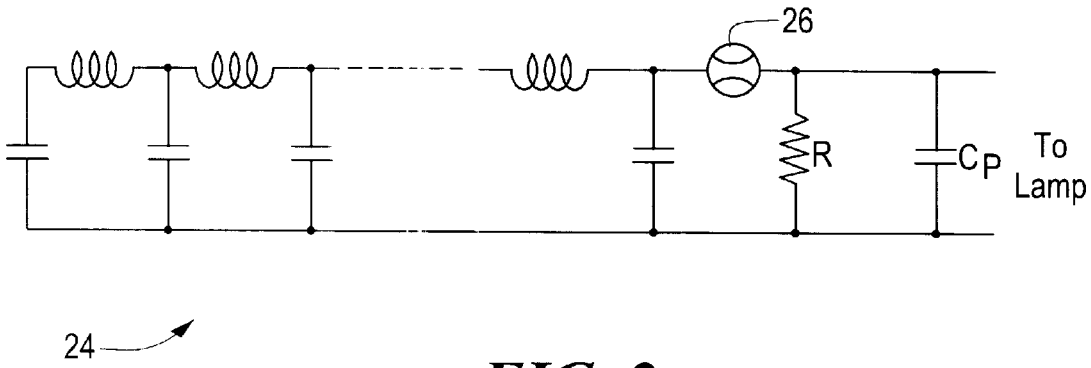
FIG. 2 PRIOR ART
FIG. 2 is a schematic diagram of a known pulse forming network.

A typical pulse forming network is shown in FIG. 2 and having a plurality of stages 24 composed of shunt capacitors interconnected by inductors. The output of the PFN is connected by way of a spark gap switch 26 to a shunt resistor R and peaking capacitor Cp. The peaking capacitor is connected to the terminals of the lamp. The values of the capacitors and inductors and the number of stages employed are designed to suit intended impedance requirements of the lamp and also to suit the pulse width and amplitude of the energizing pulses. The PFN may also be implemented with only one or more capacitors.

In operation a high voltage pulse from the PFN 20 is applied to the electrodes 12 and 14 upon closure of switch 18 to cause the formation of a plasma on the front surface of substrate 10 between the electrodes. The plasma burst in response to the energizing electrical pulse produces the intended radiation.

Figure 3:
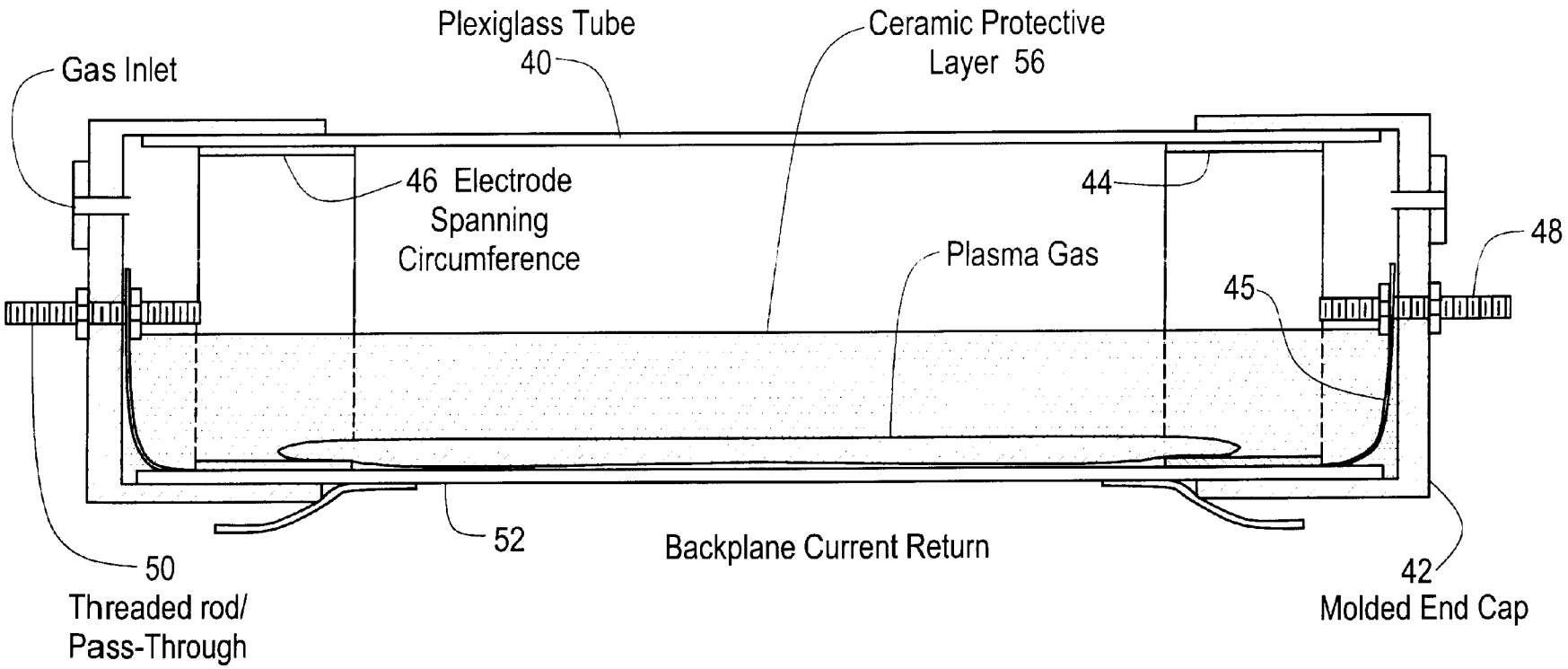
FIG. 3 is an elevation view of a tubular surface discharge lamp according to the invention.

Referring to FIG. 3, there is shown a surface discharge lamp constructed in accordance with the invention and of a tubular embodiment. A plastic tube 40 has plastic endcaps 42 bonded thereto. The tube functions as the substrate and as the gas enclosure. Typically the tube 40 is a plastic such as polycarbonate or polymethylmethacrylate. The endcaps are also typically plastic such as polymethylmethacrylate or ABS. The endcaps are typically bonded to the plastic tube by a suitable adhesive such as Epotek 302 clear epoxy. The electrodes are formed by steel sheets formed into respective rings 44 and 46 disposed in respective ends of the tube. Each of the electrodes has a strap portion 45 connected to a respective conductive rod 48 and 50 which passes through a respective end cap. This electrode arrangement is effective and inexpensive. The steel or other metal is maintained in intimate contact with the inner surface of tube 40 by the spring action of the metal when formed into the ring shape. Other electrode configurations can be employed. Preferably the electrode is in contact with the entire width of the active substrate area for efficient plasma creation confronting the entire backplane.

A conductive backplane 52 is disposed on the outside of the tube 40 between the endcaps and functions as a heat sink as well as for electrical purposes. One end of the backplane is electrically connected to the ground rod when the lamp is used alone as a single lamp. The backplane is connected to the backplane of similar lamps when multiple lamps are employed, as will be described below. In the illustrated embodiment the backplane is formed by an aluminum or other metal tape glued to the outside surface of the tube 40 between the end caps. A flat metal braid is disposed over the aluminum tape and is maintained in electrical contact by an adhesive tape or other appropriate retention structure to increase the current carrying capacity of the ground plane. The tube is typically about 12 inches long and about 3 inches in outside diameter. The backplane is about one-half inch wide and about nine inches long. Various other versions of this tubular lamp may be made in lengths and shapes which are suitable for particular purposes, such as for special lighting effects or for entertainment applications.

A high temperature insulative material is applied as a coating 56 to about one-third of the inside surface of the tube. This coating is typically a ceramic material and prevents excessive ablation of the plastic tube material, which would cause carbon deposition in response to the high pulse energy. A gas, typically xenon, is sealed in the tubular enclosure and is at a pressure of about 10 psig. The plasma discharge is formed on the inner surface of the tube in the area of the backplane.

Figure 4B:
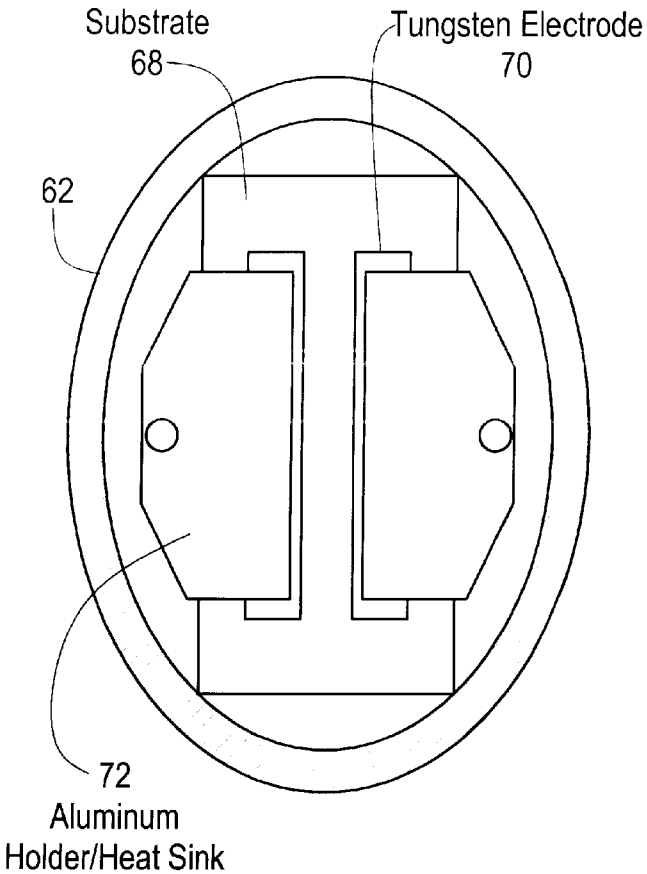
FIG. 4B is a top view of the embodiment of FIG. 4A.
Figure 4A:
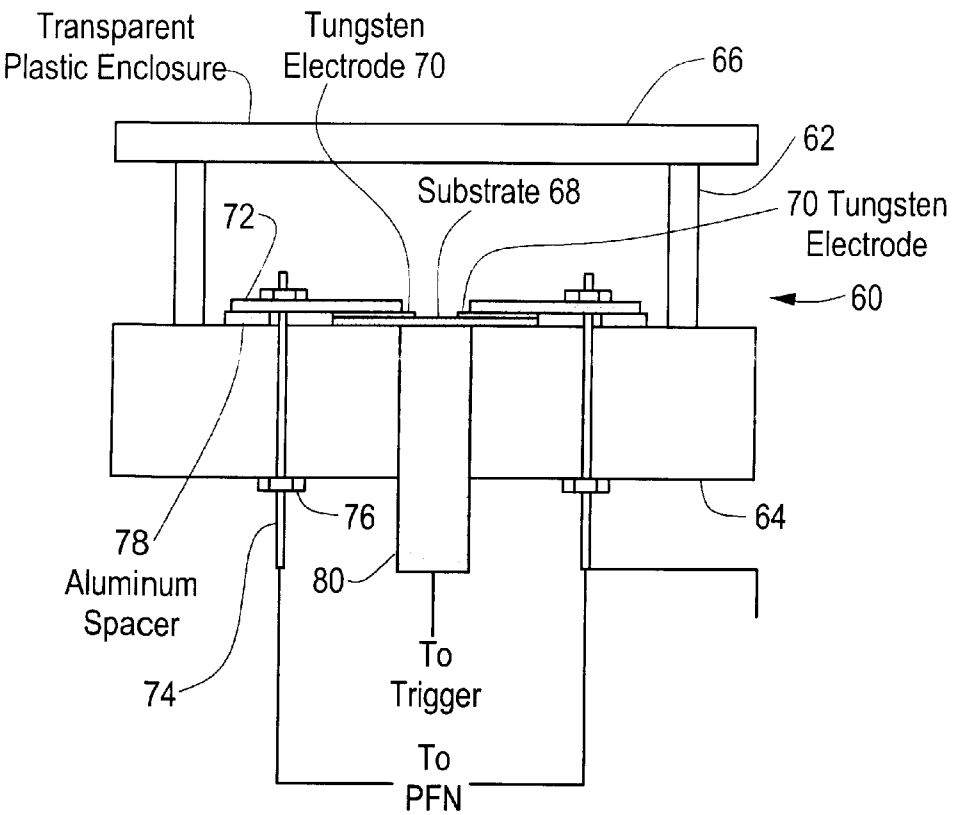
FIG. 4A is an elevation view of an embodiment of the invention useful for high repetition rates.

An embodiment of the lamp is shown in FIG. 4A and FIG. 4B which produces high repetition pulses and which is of rugged construction to withstand vibration and other forces of an environment in which it is used, such as on board an aircraft. This embodiment employs a cylindrical plastic enclosure 60 having a cylindrical side wall 62, bottom plate 64 and top plate 66. A generally rectangular substrate 68 of alumina is bonded to the surface of the bottom plate by a suitable adhesive such as Torr-Seal. Tungsten electrodes 70 are disposed on the outer surface of the substrate and are maintained in position by aluminum plates 72 secured to the enclosure by threaded rods 74 and fasteners 76. Aluminum spacers 78 are provided on the outer ends of the aluminum plates to maintain a uniform spacing to ensure good contact between the aluminum plates and associated electrodes.

A rectangular metal block 80 is disposed in an opening in the bottom plate 64 in intimate contact with the substrate and serves as a backplane and also as a heat sink. This block is of a width to extend across the gap between confronting electrodes 70 and is of a length slightly shorter than the electrode length to avoid enhancement of electric fields at the electrode ends which would cause the plasma discharges to form primarily at the ends. This embodiment is essentially of planar configuration. The long flat electrodes are separated by a distance appropriate for the particular charging voltage. Such charging voltage is usually limited to about 2,000 volts or less when using a solid state PFN. For many applications lower voltages typically about 600 volts are sufficient. The aluminum plates 72 are operative to hold the electrodes in position on the substrate and are also operative as heat sinks to dissipate heat and minimize the increase in temperature within the enclosure during operation. The size of the plates is determined to provide the requisite amount of heat sinking.

The electrodes 70 are connected to a PFN by means of the threaded rods 74. The blackplane 80 is connected to a trigger pulse source. A suitable gas environment is provided within the enclosure 60. The lamp serves as the high voltage switch that discharges the capacitors of the PFN when the lamp is externally triggered. Between triggering pulses, the lamp recovers its insulating properties. Recharging of the pulse capacitors requires currents only about one tenth of those passed by the lamp. The trigger pulses are provided in synchronization with a camera for photographic applications, and the trigger pulses applied to the external backplane are of small energy in a voltage range of about three to five kV. A typical pulse creates only one or two streamers between the electrodes. Subsequent pulses form at different locations to permit spreading of the heat load throughout the electrode gap region. The lamp has high power capability because of the heat sinking provided by the backplane and by the aluminum plates to limit the temperature rise within the lamp enclosure. The external backplane allows a compact lamp construction as it is not located inside the enclosure. Arcing between the electrodes and the backplane is eliminated by the enclosure and external air environment, rather than by large standoff distances within the enclosure as in conventional structures. Pulse widths of a few microseconds or shorter can be provided to produce pulses and pulse repetition rates appropriate for high speed photography.

Figure 5:
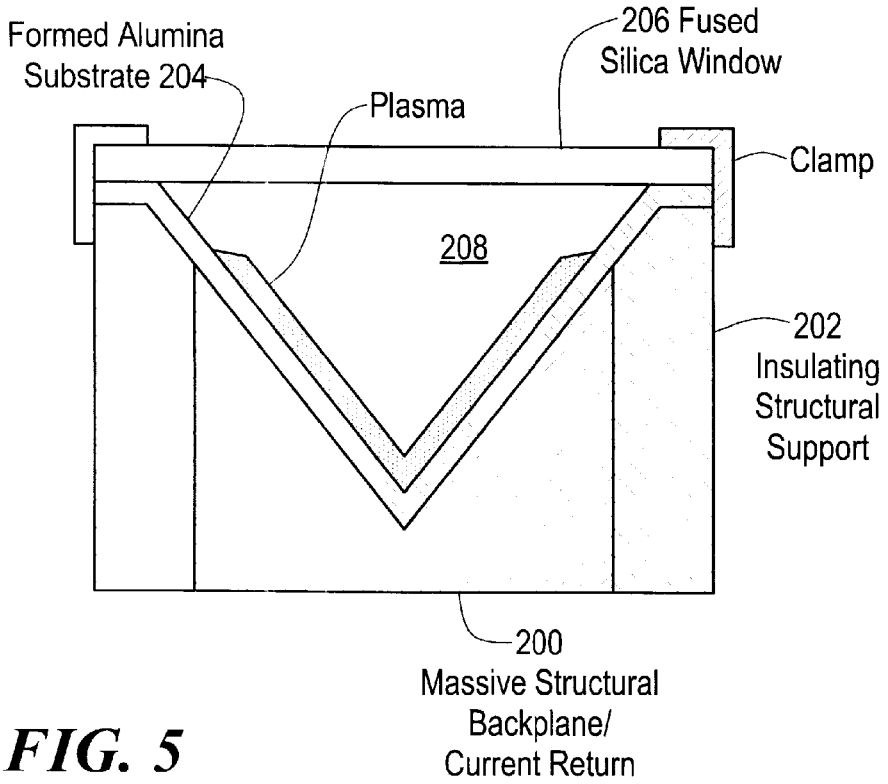
FIG. 5 is an elevation view of another embodiment of the invention employing a V shaped substrate.

The lamp for either single pulse or repetitive pulse purposes can be constructed in various geometries to suit the desired installation requirements and illumination characteristics. A high thermal conductivity material such as alumina can be employed as the substrate. Alumina is available in the green state that can be shaped to fit the intended geometry of the lamp in which it is employed. An embodiment is shown in cross section in FIG. 5 in which the alumina substrate is shaped to fit the contour of the backplane. Referring to FIG. 5 a backplane 200 is provided by a V shaped metal block disposed within an insulating structural support 202. An alumina substrate 204 is disposed in the V shaped surfaces of the block 200 and extends over the structural support 202 as shown. A fused silica or other optically transmissive window 206 is disposed over the upper edges of the substrate and is clamped to the structural support 202 to provide a sealed enclosure. Although not shown the enclosure includes end plates to provide a sealed chamber 208 which contains a suitable gas such as xenon. A pair of electrodes (not shown) are provided at respective ends of the substrate 204 and are connectable to a PFN. The backplane 200 is connectable to an external trigger source for repetitive pulse operation, or is connected to the ground electrode for single pulse operation. During operation a V shaped plasma is produced as illustrated.

Figure 6:
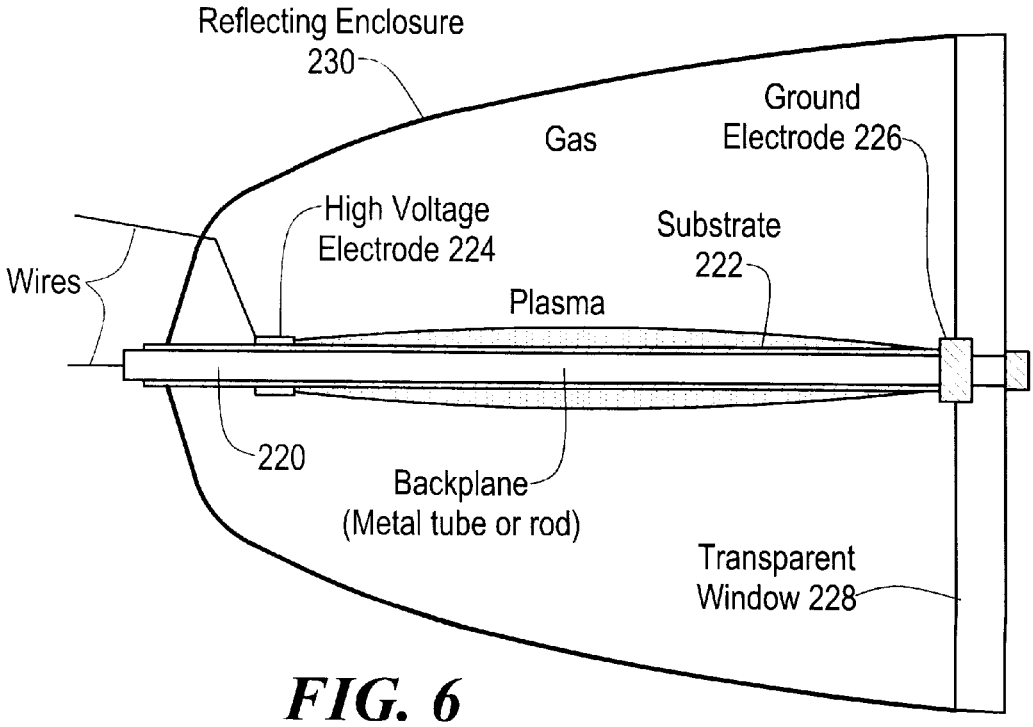
FIG. 6 is an elevation view of yet another embodiment employing a cylindrical substrate.

Another embodiment is shown in FIG. 6, in which a cylindrical plasma is provided within a parabolic or other reflective housing. The backplane is provided by a metal tube 220 about which is disposed a substrate 222 of alumina or fused silica. The tube interior is not exposed to the gas environment of the lamp and can be cooled by air or other coolant flowing therethrough. Electrodes 224 and 226 of ring shape are provided around respective ends of the substrate as shown, and these electrodes are connectable to a suitable energy source. The backplane is electrically connected to the ground electrode to serve as a current return. The rod 220 is mechanically supported by an opening in the transparent window 228 and an opening in the reflecting enclosure 230. The rod 220 could alternatively be cantilevered from one end. The plasma covers the entire circumference of the tube between the electrodes. The length of the plasma and its position can be confined to a region along the axis that is best collimated by the reflector. In this embodiment the light output is confined to a small angle of divergence to illuminate subjects at a distance. Many other geometries can be provided in accordance with the principles of the invention.

For applications in which high power must be further dissipated, the backplane can be cooled by a coolant fluid flowing across the backplane surfaces or through openings or channels formed in the backplane. The backplane may also have a finned construction to increase the heat dissipation surfaces. The gas within the enclosure can also be circulated and cooled to provide thermal management. The gas can be moved by active means such as a pump. Alternatively, the pressure increase during lamp operation can be used to cause circulation of gas through a reservoir/heat exchanger as shown in FIG. 7.

Figure 7:
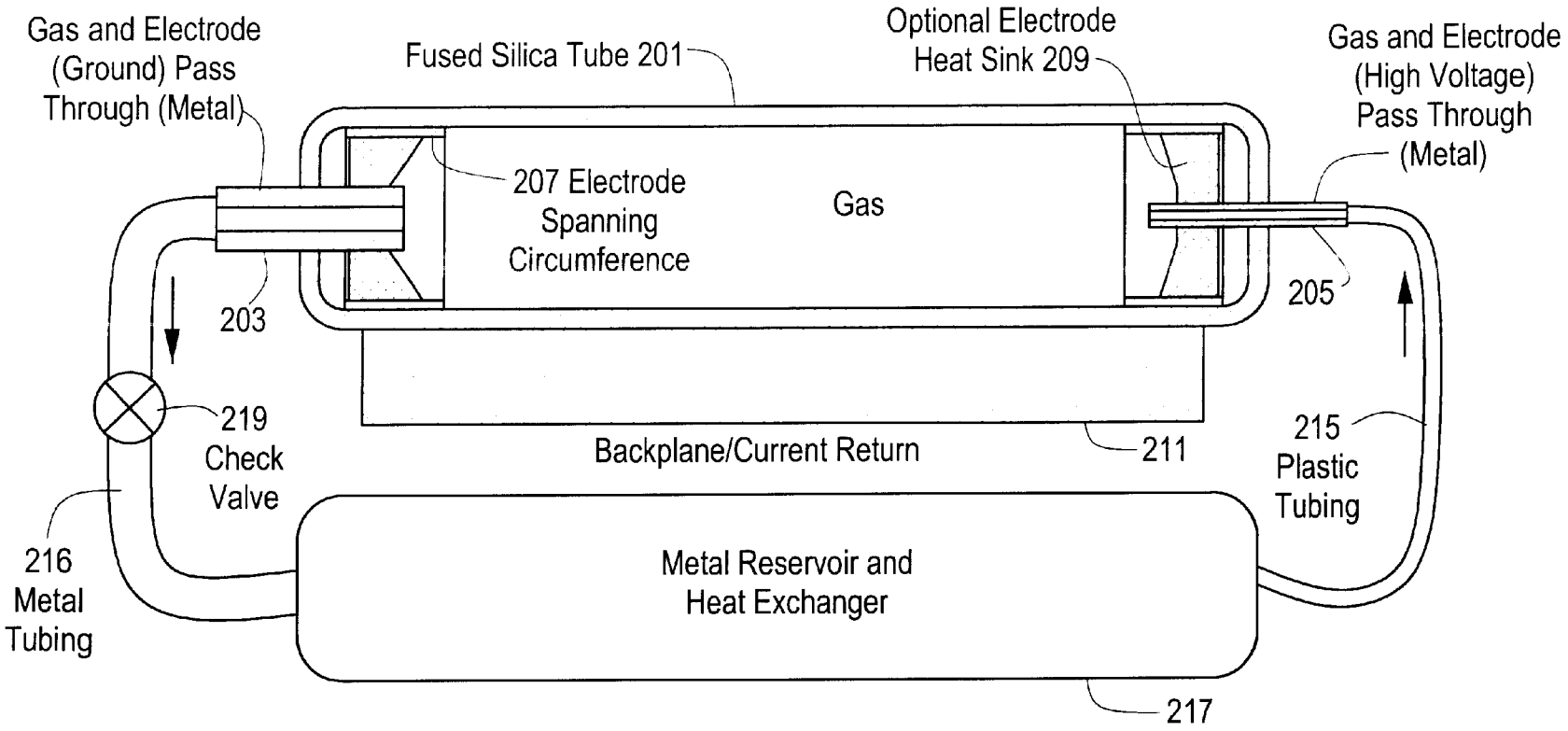
FIG. 7 is a diagrammatic view of an embodiment having a tubular substrate and gas cooling arrangement.
Figure 8:
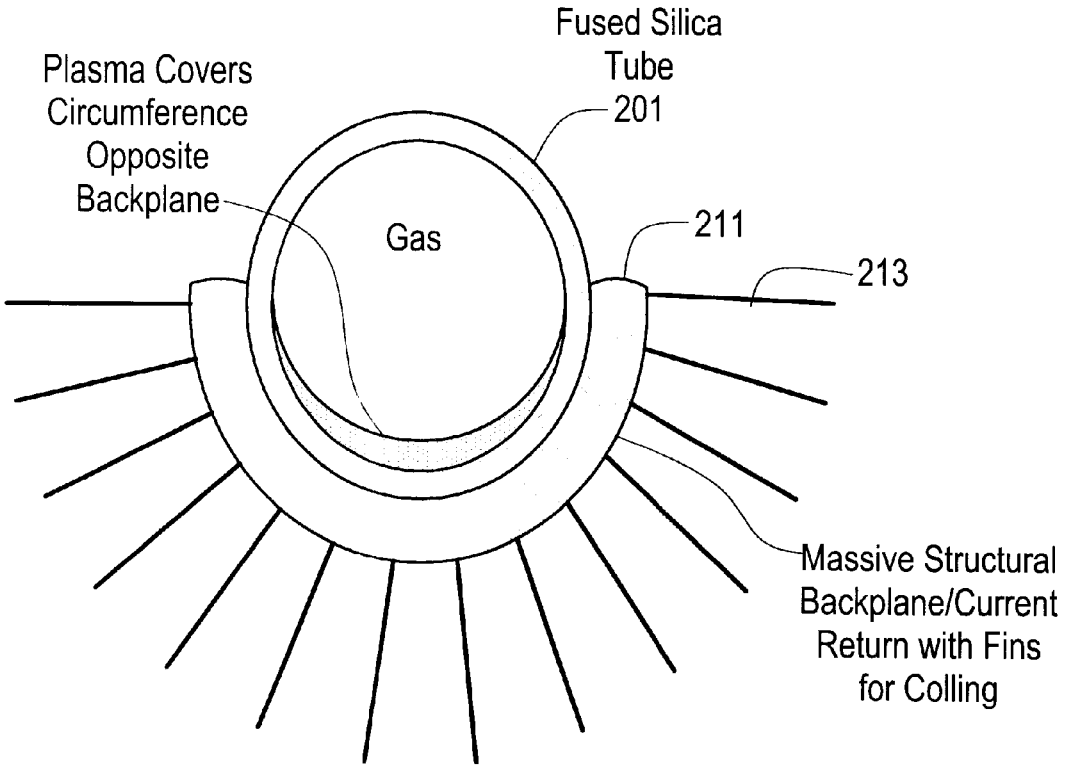
FIG. 8 is an end view of a portion of the embodiment of FIG. 7 illustrating the backplane and cooling fins.

Referring to FIG. 7 a lamp is shown in which the substrate is provided by a fused silica tube 201. Metal tubes 203 and 205 are disposed in respective ends of silica tube 201 and serve as electrodes as well as tubes for gas cooling. Ring shaped electrodes 207 and 209 may also be employed as shown to provide larger electrodes which also function as heat sinks. A thermally massive backplane 211 is provided on the outside of tube 201 and is of hemispherical configuration as shown in FIG. 8. The backplane may have an array of fins 213 for cooling. The electrode 205 is connected via electrically insulative plastic tubing 215 to a reservoir and heat exchanger 217. The tubing 216 connects electrode 203 to reservoir 217 via a check valve 219. The tubing 216 is metal for thermal dissipation and is of larger diameter than that of tubing 215. The metal tubing also has higher temperature capability to handle the hot exhaust gas from the lamp. A gas such as xenon is provided within the enclosure of tube 201, and the gas is caused to circulate in the direction of the arrows in response to a pressure increase within tube 201 during lamp operation. The plasma in this embodiment is of generally hemispherical shape disposed near the wall of tube 201 adjacent to the backplane 211. This embodiment can be employed as a large single pulse lamp operating at low repetition rate, or as a smaller energy lamp at higher repetition rates. For higher repetition rate operation, a check valve is usually inserted in tubing 215 to maintain unidirectional flow.

Figure 9A:
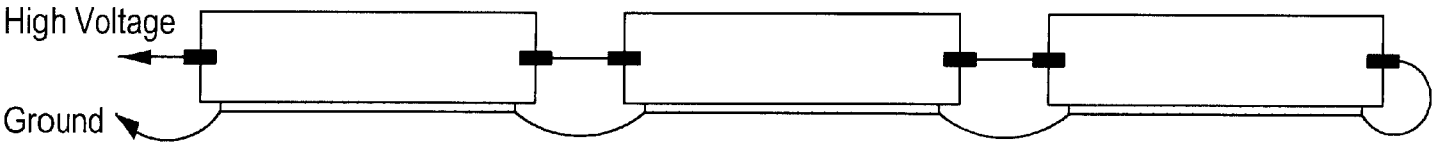
FIG. 9A is a schematic of three lamps connected in series to provide a long thin illumination source.
Figure 9B:
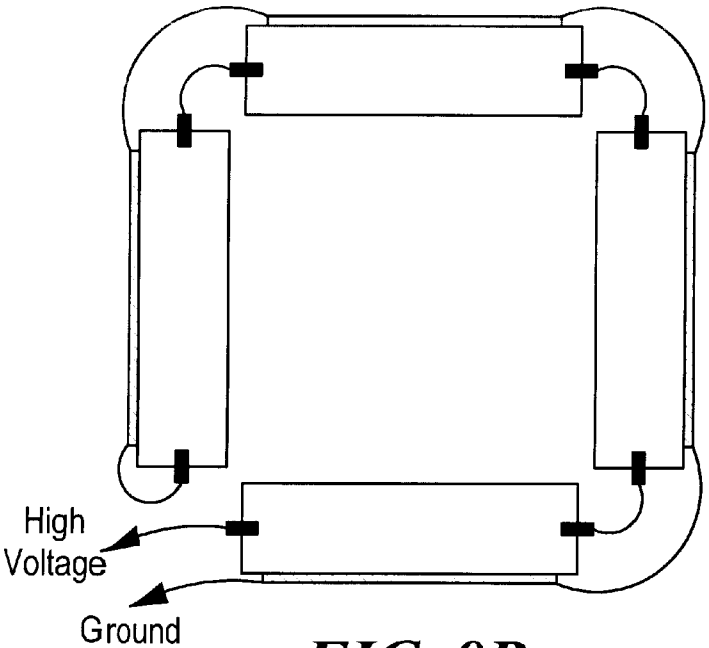
FIG. 9B is a schematic of four lamps arranged in a square configuration.
Figure 9C:
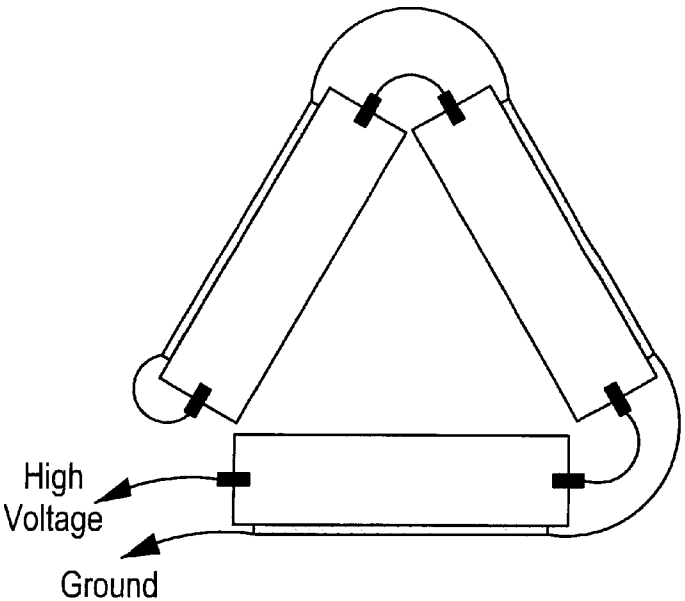
FIG. 9C is a schematic of three lamps arranged in a triangular configuration.

The modularity of the lamps permit several lamps to be interconnected in series and/or in parallel to provide flexible geometry to meet illumination requirements and size constraints that cannot be met with fixed systems. In FIG. 9A three lamps are wired in series to provide a long thin illumination source. FIG. 9B shows four lamps arranged in a square to illuminate a large confined area. FIG. 9C shows three lamps arranged in triangular configuration to provide uniform illumination of a small central area.

A long ribbon plasma is required to match the impedance of the PFN. A single lamp sufficiently long to meet the impedance requirements would be too large to concentrate the light in the area to be illuminated. The modular lamps can be arranged in series to meet the impedance requirements but can be configured into the geometry needed to satisfy illumination and size requirements. It is evident in the embodiments of FIGS. 9A–9C that the electrodes are interconnected in series and the backplanes are interconnected in series.

Figure 10:
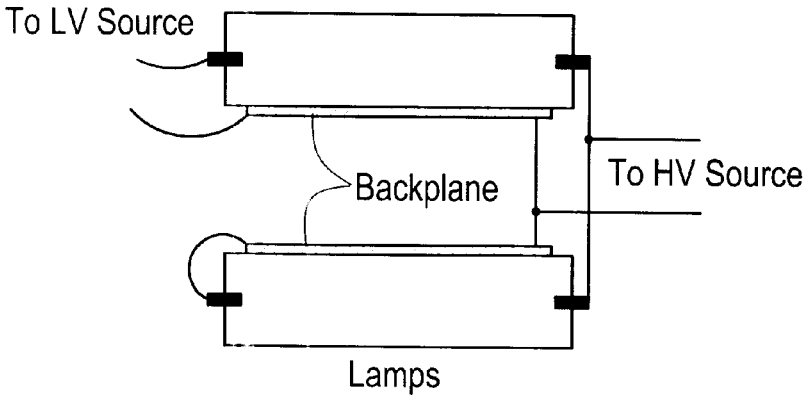
FIG. 10 is a schematic of a series/parallel interconnection of a pair of lamps useful for low voltage operation with an overvoltage trigger.

A configuration is shown in FIG. 10 which includes two lamps interconnected in a series/parallel arrangement and useful for low voltage operation, typically from about 500 V up to a few kV, with an overvoltage trigger, typically about 8 kV. The lamps are connected in a series to a low voltage power source which includes the PFN. The lamps are connected in parallel to a high voltage source. The lamps are initially triggered by the high voltage from the high voltage source and the discharge is maintained by the lower voltage from the low voltage source.

Figure 11B:
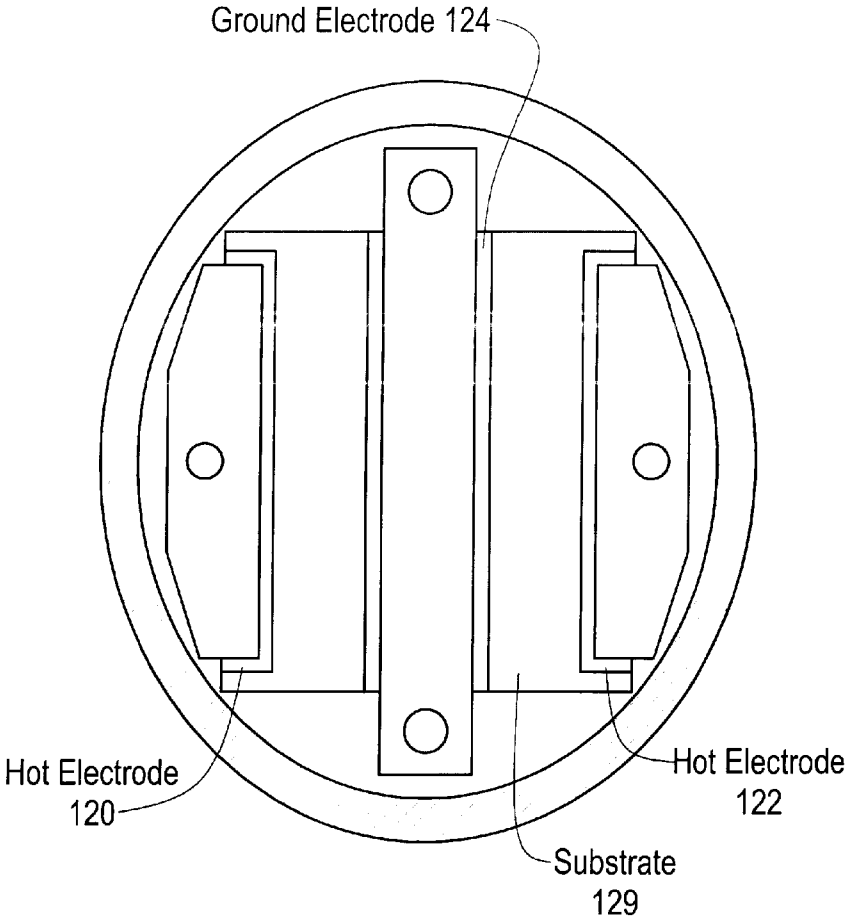
FIG. 11B is a top view of the lamp of FIG. 11A.
Figure 11A:
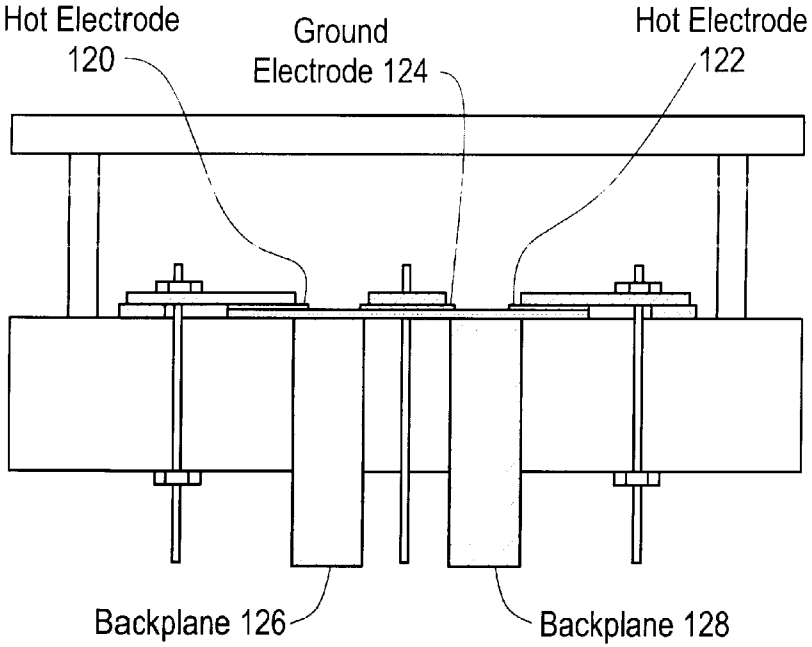
FIG. 11A is an elevation view of a lamp employing two high voltage electrodes.

An embodiment is shown in FIGS. 11A and 11B in which two hot electrodes 120 and 122 are employed, one on each side of a common ground electrode 124. This embodiment is similar in its assembly to that of FIGS. 4A and 4B. Each electrode is discharged only on alternate pulses to permit doubling of the pulse repetition rate. Two backplanes 126 and 128 are provided on the back side of the substrate 129 and are alternately triggered to provide the repetitive pulses. The hot electrodes can be further subdivided to further increase the repetition rate.

Figure 12:
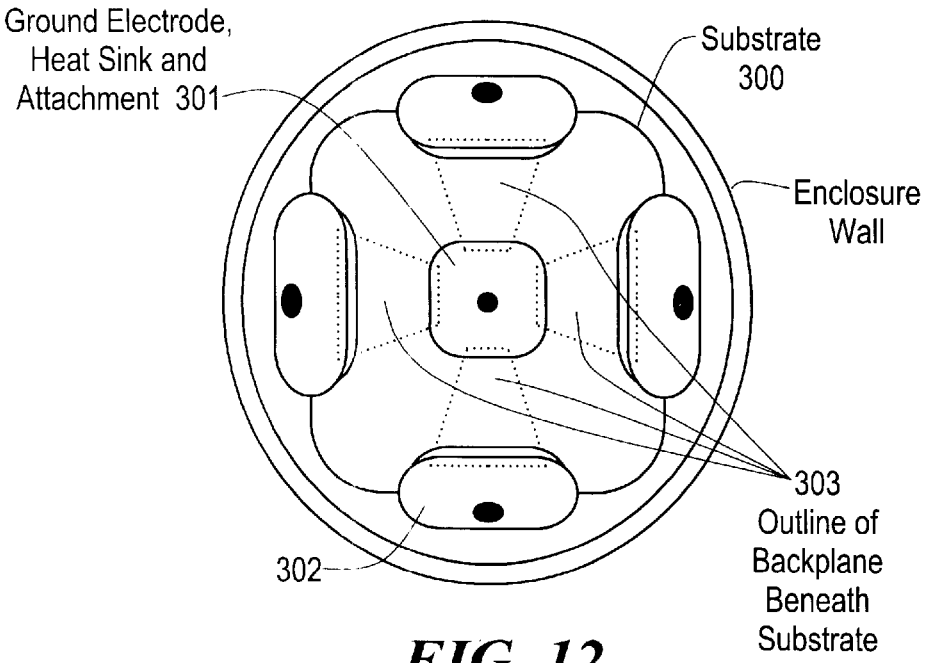
FIG. 12 is a top view of a lamp employing four high voltage electrodes.

The employment of multiple high voltage electrodes also is beneficial in enhancing the power capability of the lamp especially high repetition rate lamps. A high repetition rate lamp with four electrodes is shown in FIG. 12. A substrate 300 is of generally rectangular configuration having rounded corners and is disposed within an enclosure. A ground electrode 301 is provided at the center of the substrate and four high voltage electrodes 302 are disposed about the periphery of the substrate as shown. Four backplanes are provided beneath the substrate each of which straddles the gap between the ground electrode and a respective high voltage electrode as illustrated by the dotted outline. Each electrode may have its own pulse capacitor or PFN. The electrodes can be fired in sequence to increase the maximum repetition rate by a factor of four. The electrodes can also be simultaneously fired to increase the pulse energy by a factor of four.

Figure 13:
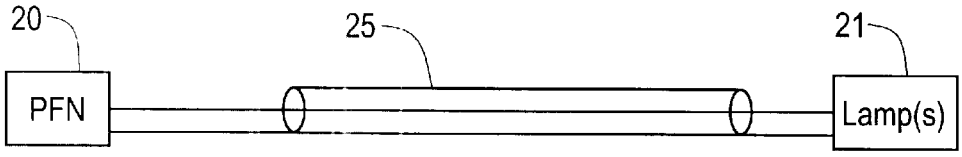
FIG. 13 is a schematic illustrating the remote location of a pulse forming network and lamp(s)

The lamps are separated from the PFN in many instances by a low inductance high capacitance cable. As shown in FIG. 13, the PFN 20 is connected to the one or more lamps 21 by a length of low inducture high capacitance cable 25. The cable serves as a peaking capacitor that causes a transient voltage doubling across the lamps and which assists in the plasma initiation process. It is often advantageous to separate the PFN from the lamps and for some applications such separation may be necessary. For example, in photographing events in which space is very limited and in which the lamps may be destroyed by an explosive or other event being photographed, the PFN and other components of the illumination system can be maintained a safe distance remote from the test site. Since the cable extends the pulse due to the cable inductance, the intended pulse width can be maintained relatively short by eliminating the inductance coils in the PFN and employing only capacitors.

Figure 14:
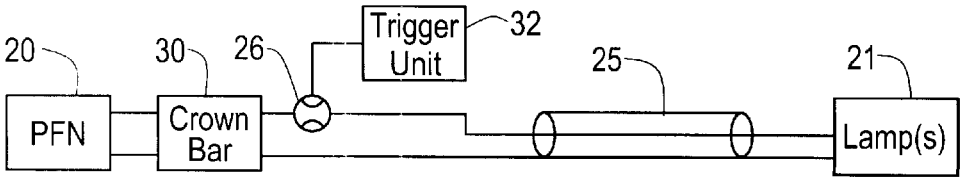
FIG. 14 is a schematic of an illumination system employing a crowbar circuit.
Figure 15:
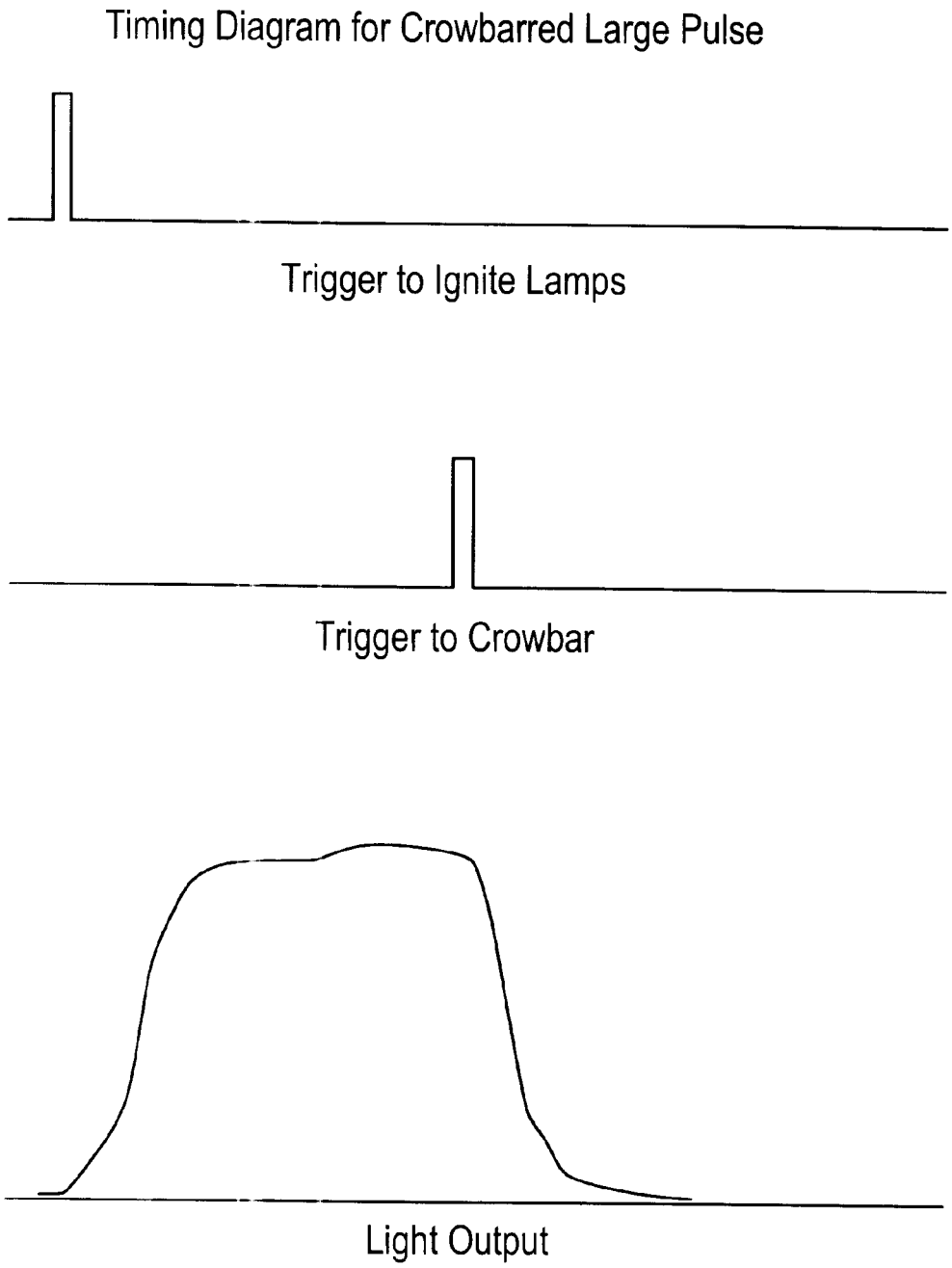
FIG. 15 is a timing diagram associated with the system of FIG. 14.

For certain photographic systems, the camera may not have a sufficiently fast shutter to control exposure. In this event, the exposure is determined by the illumination system which should provide an illumination pulse having a rapid rise time and an abrupt selectable termination to produce the intended pulse duration and corresponding illumination level. The multi-stage PFN network can accomplish the required pulse shaping and selectable pulse duration. In order to provide selectable pulse duration and to terminate the pulse more rapidly when impedance matching between the lamps and the PFN is not exact, a crowbar circuit can be employed which causes a short circuit to rapidly terminate the driving pulses. In one implementation, the crowbar is disposed across the lamp terminals, at which position there is the lowest inductance and fast pulse termination can be achieved. Where a long cable is employed which separates the PFN from the lamps, the crowbar is typically placed across the PFN, as shown in FIG. 14. The crowbar 30 is connected via a spark gap switch 26 to the interconnecting cable 25, the other end of the cable being connected to the one or more lamps 21. A trigger unit 32 fires the spark gap 26 which permits the pulses from PFN 20 to be applied via cable 25 to the lamp(s) 21. The crowbar circuit 30 shunts the PFN output to terminate the driving pulses. An associated timing diagram is shown in FIG. 15 illustrating a trigger pulse to initiate a light burst, and a crowbar pulse to terminate the light burst.

Figure 16:
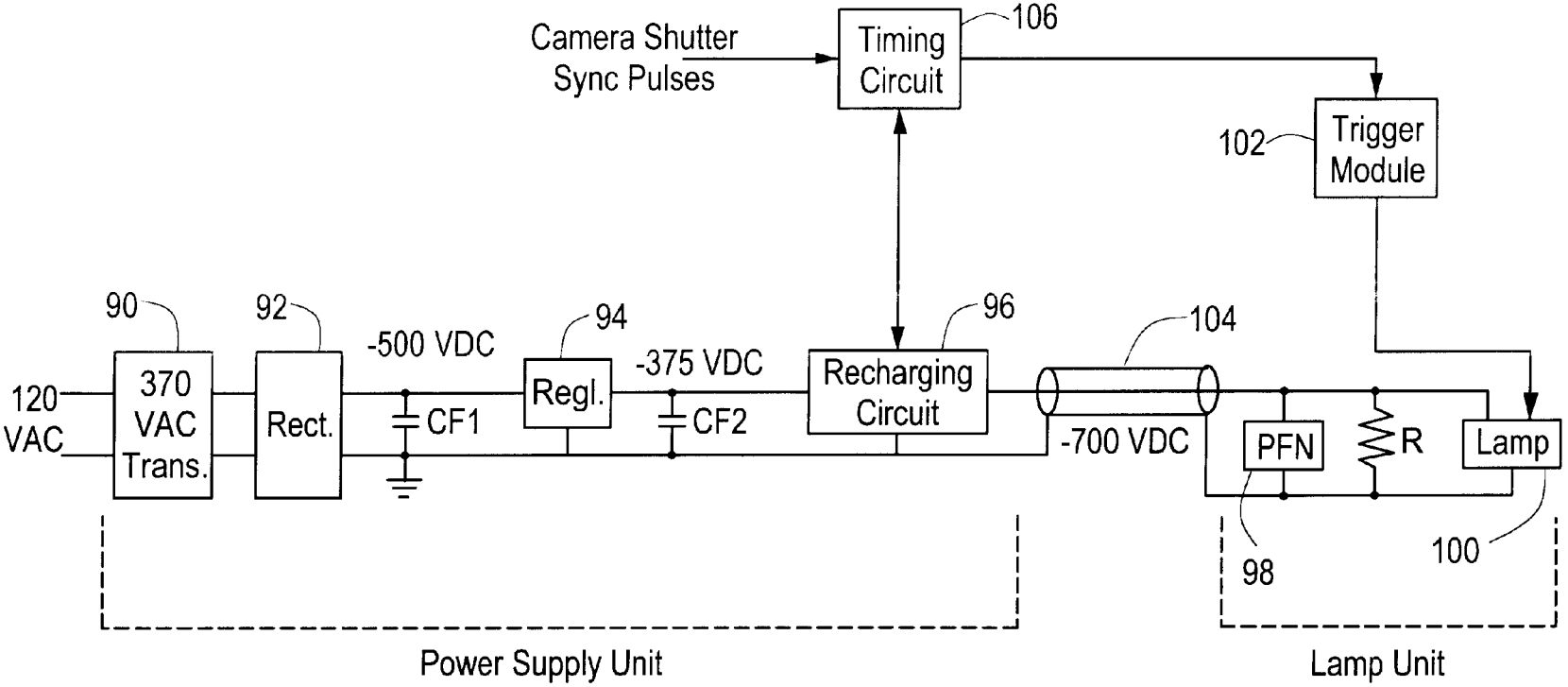
FIG. 16 is a schematic diagram of a repetitively pulsed system.
Figure 17:
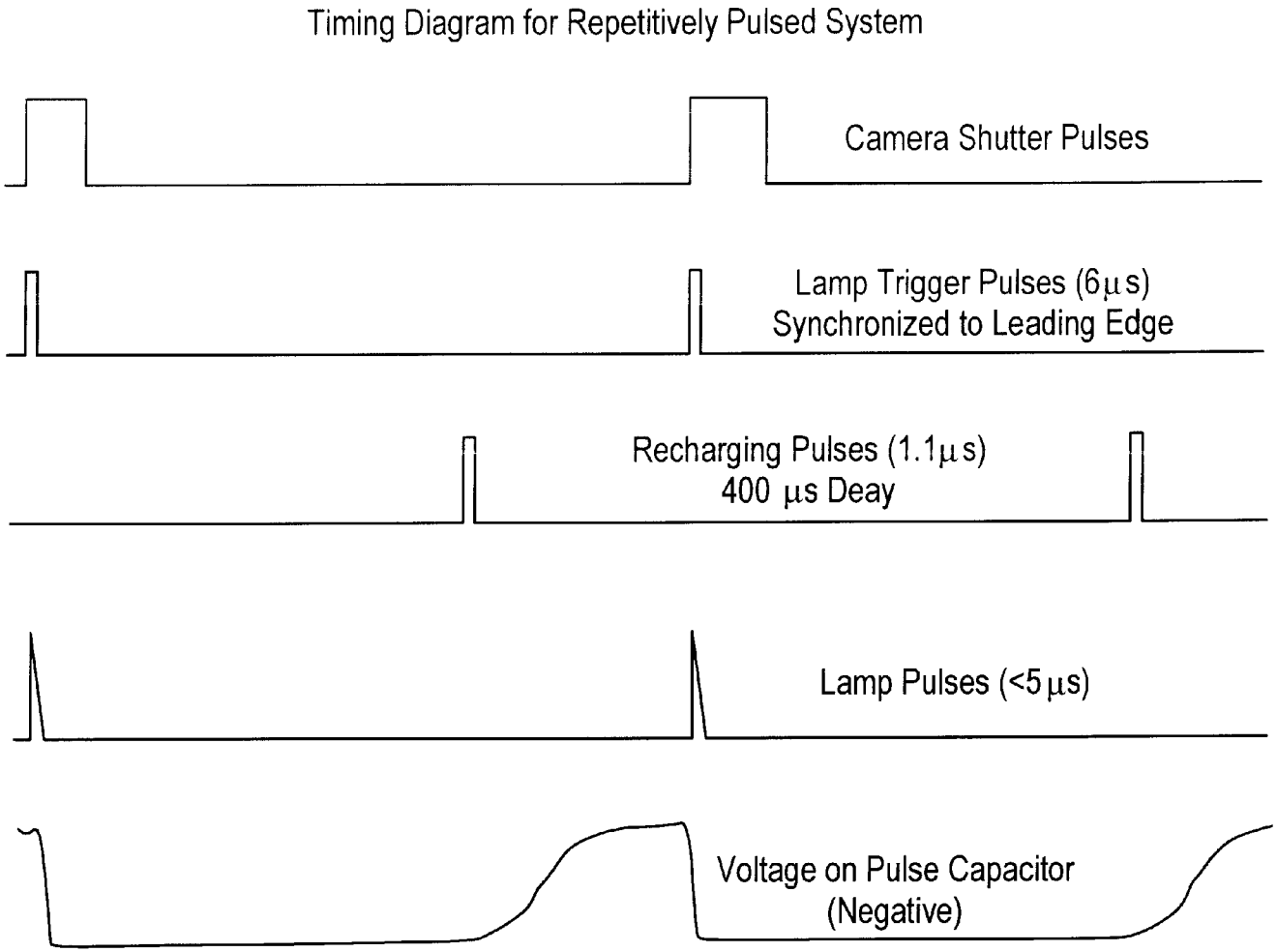
FIG. 17 is a timing diagram associated with the system of FIG. 16.

An electrical system for the repetitively pulsed lamps is shown as an example in FIG. 16 and includes a power supply unit and a lamp unit. A timing diagram for the electrical system in shown in FIG. 17. Line power of 120 is raised to 370 VAC using a machine tool transformer 90 that can withstand large current surges. The 370 VAC power is rectified by rectifier 92 to provide a no load peak DC voltage of about 500 volts. The system is operated with negative polarity and thus the filter capacitor CF1, is maintained at −500 volts before the burst of pulses. A regulator 94 maintains the desired voltage, which typically is −375 VDC, on a second filter capacitor CF2. When the system is operating, the voltage of the first capacitor CF1 initially drops until the transformer 90 can replenish the charge but the lower regulated voltage is maintained on the second capacitor CF2. The output of the regulator 94 does not directly feed the PFN 98 but a recharging circuit 96 is used to prevent the PFN from reaching high voltage before the lamp 100 has deionized after a pulse. The power supply unit is often located separate from the lamp unit which comprises the lamp trigger module 102 and PFN 98. A coaxial cable 104 such as RG-8 interconnects the lamp unit and the power supply unit for such a separated installation. For some purposes, the cable can be a low inductance high capacitance coaxial cable, as in the single burst version described above, wherein the cable is part of the PFN.

The trigger module 102 is coupled to the backplane of the lamp 100 and is driven by camera shutter sync pulses via a timing circuit 106. The timing circuit 106 is also connected to the recharging circuit 96 for recharging of the capacitors of the PFN 98. The interconnecting cable 104 provides for remote location of the lamp unit. The PFN capacitors across the lamp terminals are normally uncharged to avoid high voltage produced during lamp operation. The capacitors are located near the lamp to reduce inductance during the discharge and to permit relatively short pulse durations. During operation the camera provides a sync pulse when the camera shutter is open. The timing circuit 106 detects the leading edge of each sync pulse and emits a signal to the trigger module 102 which generates trigger pulses that fire the lamp. Delayed recharging pulses from timing circuit 106, which are delayed long enough to ensure that the lamp has recovered its insulating characteristics after firing, command the recharge circuit 96 to charge the PFN 98. The recharging circuit 96 typically switches an SCR or other switching device on and the PFN 98 is charged through a large inductor in circuit 96 which effectively doubles the voltage, resulting in a voltage of about −700 volts on the PFN for the first pulse.

Table 1 shows typical specifications for a large pulse system employing a surface discharge lamp such as shown in FIG. 3.

TABLE 1

| Voltage [kV] | Maximum Pulse Energy [kJ] | Maximum Pulse Duration [μs] (1/3 Power) | Number of Modular Lamps | Maximum Power in Visible [MW] |
|---|---|---|---|---|
| 20 | 3.3 | 35 | 3 | 10.6 |
| 20 | 10 | 70 | 3 | 15 |
| 15 | 12.5 | 200 | 3 | 4.7 |
| 7.5 | 12.5 | 1000 | 2 | 1.2 |

Table 2 shows typical specifications for an 8000 pulse burst repetitively pulsed system using two lamps for uniform illumination. The lamps can be such as those shown in FIGS. 4A and 4B.

TABLE 2

| Pulse Energy [J] | Voltage [V] | Pulse Duration [μs] | Maximum Pulse Repetition Rate [Hz] | Pulsed Power [W] | Average Visible Power Output [W] |
|---|---|---|---|---|---|
| 1 | −700 | <5 | 1800 | 1800 | 180 |
| 0.3 | −700 | <2 | 3000 | 900 | 90 |
| 0.1 | −700 | <1 | 3700 | 370 | 37 |

The lamps can be employed for purposes other than photography or imaging. The lamps can be employed and configured to meet other illumination requirements for diverse purposes such as water treatment, sterilization, paint removal, and as UV or IR sources. The output wavelength of the lamp can be changed by selecting different substrate materials and different host gases. The pressure of the gas can be adjusted over a wide range to meet requirements for illumination intensity and to meet impedance and size requirements. Vacuum discharges can be created to limit the spectral output to the spectral bands of the substrate and the electrode atoms. Vacuum discharges are generally used to create short pulses and short wavelengths. The size and shape of the pulses can be adapted to various applications including entertainment lighting. The plasma shape is controlled by the backplane and the over voltage trigger permits long plasmas to be created. The external backplane enables the lamp to be of compact construction and to have improved thermal management.

Figure 18:
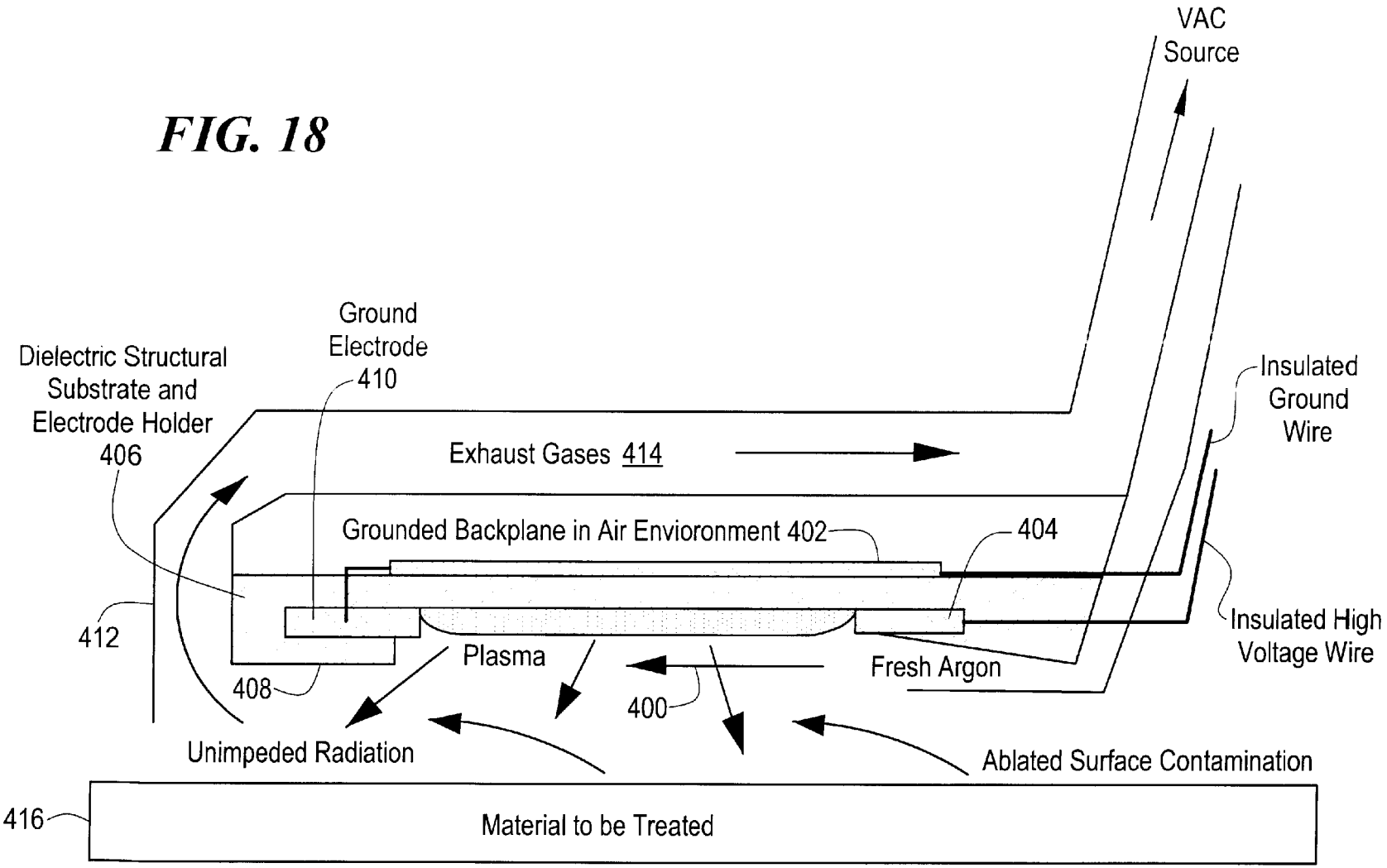
FIG. 18 is a diagrammatic side view of an embodiment of a surface discharge lamp operative without a window.

A lamp is shown in FIG. 18 which operates without a window to separate the discharge from the air. This lamp has no window and gas flows over the discharge area. Argon gas is caused to flow along a path 400 to create strong radiation in the vacuum ultraviolet region. The light would normally be absorbed by air but the flow of argon displaces the air from the path between the discharge and the target area. A vacuum source draws the used argon and products from the target back to a canister to be treated if needed. This implementation is useful for cleaning surfaces and removing coatings which generally require high irradiance and short wavelengths. The backplane 402 is exposed to the air environment so that tracking from the high voltage electrode 404 is impeded. The surface discharge configuration limits the plasma to the surface and lowers the breakdown voltages to safe levels.

A dielectric substrate 406 has an end portion 408 retaining a ground electrode 410. A high voltage electrode 404 is provided within a second end portion 408 of the substrate. The backplane 402 is provided on the back surface of the substrate and is connected to the ground electrode. The backplane and high voltage electrode are connected to a driving source by interconnecting wires. The surface discharge structure is disposed within an enclosure 412 which includes an exhaust gas path 414. In operation, a plasma is caused to form between the electrodes and radiates toward a material 416 to be treated which is in confronting relationship to the lamp. Argon from a suitable supply (not shown) is flowed across the plasma region and is exhausted via the exhaust path to a collection apparatus (not shown).

The invention is not to be limited by what has been particularly shown and described as variations and alternative implementations may occur to those versed in the art without departing from the spirit and true scope of the invention.

I claim:

1. A high intensity surface discharge lamp comprising:

a substrate of dielectric material having a front surface and a back surface;

a first electrode disposed at one end of the front surface;

a second electrode disposed at the opposite end of the front surface;

an enclosure for the substrate and electrodes and containing a gas;

a backplane of electrically and thermally conductive material disposed outside the enclosure and confronting the back surface of the substrate between the electrodes;

a first terminal connected to the first electrode and extending through the enclosure;

a second terminal connected to the second electrode and extending through the enclosure; and a conductor connected to the backplane and connectable to one of the electrodes or to an external trigger terminal.

2. The lamp of claim 1 wherein the conductor interconnects the backplane and the second electrode.

3. The lamp of claim 1 including:

an electrical energy source having a pulse forming network; and a low inductance high capacitance coaxial cable interconnecting the pulse forming network of the energy source and the first and second terminals of the lamp.

4. An illumination system for providing high intensity bursts of visible radiation comprising:

a plurality of surface discharge lamps each having:

a substrate of dielectric material;

electrodes spaced apart on a substrate surface;

a gas containing enclosure for the substrate and electrodes;

a backplane on an outside surface of the enclosure adjacent the substrate;

a first electrical interconnection for connecting the electrodes of the plurality of surface discharge lamps in series;

a second electrical interconnection for connecting the backplanes of the plurality of surface discharge lamps in series; and first and second electrical terminals each connected to a respective one of the first and second electrical interconnections and being operatively connected to an energy source.

5. A high intensity surface discharge lamp comprising:

an enclosure having a reflective interior surface of generally parabolic shape, and a light transmissive window;

a metal tube disposed along the axis of the enclosure and having ends extending outside the enclosure, the metal tube operative as a backplane;

a dielectric substrate on at least a portion of the outer surface of the metal tube within the enclosure;

electrodes on the dielectric substrate at spaced ends thereof; and electrical terminals connected to respective electrodes and backplane.

6. A high intensity surface discharge lamp comprising:

an enclosure having a plastic tube at least a portion of which is transmissive to an intended optical spectrum; the tube having respective ends;

first and second plastic end caps each bonded to a respective end of the plastic tube to form a sealed enclosure containing a gas;

a first electrode disposed on the inside surface of the tube at one end of the tube;

a second electrode disposed on the inside surface of the tube at the opposite end of the tube;

a conductive backplane disposed on the outside surface of the tube between the electrodes;

a first electrical terminal extending through one of the end caps and electrically connected to the first electrode;

a second electrical terminal extending through the other of the end caps and electrically connected to the second electrode; and an anti-ablative coating on a portion of the inside surface of the plastic tube between the electrodes.

7. The lamp of claim 6 in which the first and second electrodes each comprise a metal sheet of generally cylindrical shape in contact with the confronting interior surface of the plastic tube.

8. An illumination system for providing high intensity bursts of visible radiation comprising;

at least one surface discharge lamp including a substrate of dielectric material;

a plurality of electrodes disposed on a first surface of the substrate in spaced disposition;

an enclosure for the substrate and electrodes and containing a gas;

a backplane of conductive material disposed outside the enclosure and confronting the surface of the substrate opposite to the first surface;

electrical terminals connected to respective electrodes;

an electrical terminal connected to the backplane; and an electrical energy source including a pulse forming network connected to the terminals of the lamp.

9. The system of claim 8 including a length of coaxial cable interconnecting the pulse forming network of the energy source and the lamp.

10. The system of claim 8 wherein the energy source includes:

a regulated power supply providing a regulated DC voltage output; and trigger circuitry for providing voltage pulses to the pulse forming network in a selected time sequence.

11. The system of claim 10 wherein the pulse forming network includes a coaxial cable interconnecting the network and the lamp terminals.

12. The system of claim 10 including a crowbar circuit coupled between the lamp terminals and the power supply and operative to shunt the pulses applied to the lamp terminals to terminate the pulses.

13. A high intensity surface discharge lamp comprising:

an enclosure of electrically insulating material containing a gas;

at least a portion of the enclosure being light transmissive;

a portion of the inside surface of the enclosure being a dielectric substrate;

at least two electrodes in contact with the substrate portion of the enclosure;

electrical terminals extending through the enclosure each connected to a respective electrode;

a backplane on the outside surface of the enclosure adjacent to the substrate portion; and a terminal connected to the backplane.

14. The lamp of claim 13 further including an anti-ablation coating on the substrate portion of the enclosure.

15. The lamp of claims 13 wherein the enclosure is of generally cylindrical configuration having a cylindrical bottom plate, a cylindrical side wall and a top plate at least a portion of which is transparent to an intended optical spectrum;

and wherein the backplane is disposed within an opening provided in the bottom plate in confronting relationship to the substrate portion between the electrodes, the backplane also serving as a heat sink.

16. The lamp of claim 13 wherein the enclosure includes a bottom of V shaped configuration and a top which is light transmissive; and a dielectric substrate of V shape disposed within the V shaped bottom of the enclosure.

17. The lamp of claim 13 wherein the dielectric substrate is alumina.

18. The lamp of claim 13 wherein one of the electrodes is a ground electrode and wherein a plurality of other electrodes are disposed about the periphery of the substrate.

19. The lamp of claim 13 wherein the enclosure is tubular and wherein the terminals extend through respective ends of the tubular enclosure.

20. The lamp of claim 19 wherein the electrodes are tubular;

and including a gas supply for providing gas to the interior of the enclosure via the tubular electrodes.

* * * * *

UNITED STATES PATENT AND TRADEMARK OFFICE

CERTIFICATE OF CORRECTION

PATENT NO. : 6,229,272 B1
DATED : May 8, 2001
INVENTOR(S) : Robert G. Root

It is certified that error appears in the above-identified patent and that said Letters Patent is hereby corrected as shown below:

Column 1,
Line 8, insert -- STATEMENT REGARDING FEDERALLY SPONSORED RESEARCH OR DEVELOPMENT --; and Column 12,
Line 27, "claims" should read -- claim --.

Signed and Sealed this

Seventeenth Day of September, 2002

*Attest:*

*Attesting Officer*

JAMES E. ROGAN
*Director of the United States Patent and Trademark Office*